United States Patent [19]

Shibuya

[11] Patent Number: 4,516,920

[45] Date of Patent: May 14, 1985

[54] VARIABLE CAPACITY VANE COMPRESSOR CAPABLE OF CONTROLLING BACK PRESSURE ACTING UPON VANES

[75] Inventor: Tsunenori Shibuya, Konan, Japan

[73] Assignee: Diesel Kiki Co., Ltd., Tokyo, Japan

[21] Appl. No.: 596,001

[22] Filed: Mar. 30, 1984

[30] Foreign Application Priority Data

Apr. 6, 1983 [JP] Japan ..... 58-60566

[51] Int. Cl.[3] ..... F01C 21/16

[52] U.S. Cl. ..... 418/23; 418/268

[58] Field of Search ..... 418/23, 26, 82, 93, 418/259, 266–269, 24

[56] References Cited

U.S. PATENT DOCUMENTS 3,828,569 8/1974 Weisgerber ..... 418/23
4,260,343 4/1981 Watanabe ..... 418/269

FOREIGN PATENT DOCUMENTS 56-138489 10/1981 Japan .
57-102596 6/1982 Japan .
57-153982 9/1982 Japan .

*Primary Examiner*—Leonard E. Smith

*Assistant Examiner*—Jane E. Obee

*Attorney, Agent, or Firm*—Frishauf, Holtz, Goodman & Woodward

[57] ABSTRACT

The communication between at least one of the pump inlets opening in at least two housing cavities and the suction chamber can be interrupted by a first valve means for prohibiting fluid compression in at least one of the housing cavities associated with the at least one pump inlet. At least one of the front and rear side blocks is formed with at least two passage means at locations corresponding to different ones of the cavities for introducing compressed fluid into back pressure chambers formed in the rotor. The communication between at least one of the passage means and the suction chamber can be interrupted by a second valve means. A control means actuates the second valve means so as to interrupt the communication between the at least one passage means and the suction chamber at the same time of establishment of the communication between the at least one pump inlet and the suction chamber, to thereby reduce the back pressure acting upon vanes moving in the above at least one housing cavity while the fluid compression in the same housing cavity is prohibited.

6 Claims, 4 Drawing Figures

VARIABLE CAPACITY VANE COMPRESSOR CAPABLE OF CONTROLLING BACK PRESSURE ACTING UPON VANES

BACKGROUND OF THE INVENTION

This invention relates to variable capacity vane compressors, and more particularly to a vane compressor of this kind which is capable of controlling the back pressure acting upon vanes in response to operating conditions of the compressor.

Vane compressors of the type which is capable of varying the capacity thereof and adapted for use in air conditioning systems such as car coolers generally have a plurality of housing cavities defined between the pump housing and the rotor received therein. For reduced capacity operation, at least one of the housing cavities is kept disconnected from the suction chamber to prohibit fluid compression in the at least one housing cavity. Variable capacity vane compressors of this kind have been disclosed e.g. in Japanese Provisional Patent Publications (Kokai) Nos. 56-138489, 57-153982, and 57-102596.

In such vane compressors, vanes are radially slidably fitted in slits formed in the rotor within the pump housing and are pushed radially outward by a centrifugal force produced by the rotation of the rotor and the pressure of compressed fluid introduced as back pressure into back pressure chambers formed in the rotor through gaps between the rotor and the side blocks of the pump housing as well as gaps between the vanes and the slits so as to have their radially outer ends in sliding and urging contact with the camming inner peripheral surface of the pump housing.

However, in such a vane compressor having a plurality of housing cavities, the back pressure chambers communicating with respective vanes in the housing cavities are communicated with each other by means of an annular groove formed in the rotor, as disclosed e.g. in Japanese Provisional Patent Publication No. 57-153982 referred to above. Consequently, even when the fluid compression is prohibited in part of the housing cavities, part of the compressed fluid is introduced into back pressure chambers corresponding to vanes moving in the housing cavity in which the fluid compression is prohibited, so that the vanes moving in the above housing cavity are urged against the camming inner peripheral surface of the pump housing with a large urging pressure. This results in large power loss of the compressor as well as in a great amount of wear of the pump housing and the vanes. No solution to this problem has been provided by any of the aforementioned publications.

SUMMARY OF THE INVENTION

It is the object of the invention to provide a variable capacity vane compressor which is capable of reducing the back pressure acting upon vanes moving in part of the housing cavities in which fluid compression is prohibited, to thereby largely reduce the power loss of the compressor as well as prevent wear of the vanes and the pump housing.

The present invention provides a variable capacity vane compressor of the type having at least two housing cavities defined between the pump housing and the rotor, at least two pump inlets opening in different ones of the housing cavities, and first valve means for selectively establishing and interrupting communication between at least one of the pump inlets and the suction chamber.

The vane compressor according to the invention is characterized by the following:

At least two passage means are formed in at least one of the front and rear side blocks forming part of the pump housing at locations corresponding to different ones of the above cavities and separated from each other, for supplying back pressure chambers formed in the rotor with compressed fluid as back pressure from respective ones of the cavities.

At least one communication means is formed in the above at least one side block for communicating at least one of the above passage means corresponding to the above at least one pump inlet with the suction chamber. This communication can be selectively established and interrupted by second valve means.

Control means for controlling the first valve means and the second valve means is adapted to cause the first valve means to interrupt the communication between the at least one pump inlet and the suction chamber, and at the same time cause the second valve means to establish communication between the at least one passage means and the suction chamber by way of the communication means, thereby reducing the pressure of compressed fluid supplied to the back pressure chambers by way of the at least one passage means.

The above and other objects, features and advantages of the invention will be more apparent from the ensuing detailed description taken in conjunction with the accompanying drawings.

DETAILED DESCRIPTION

Figure 1:
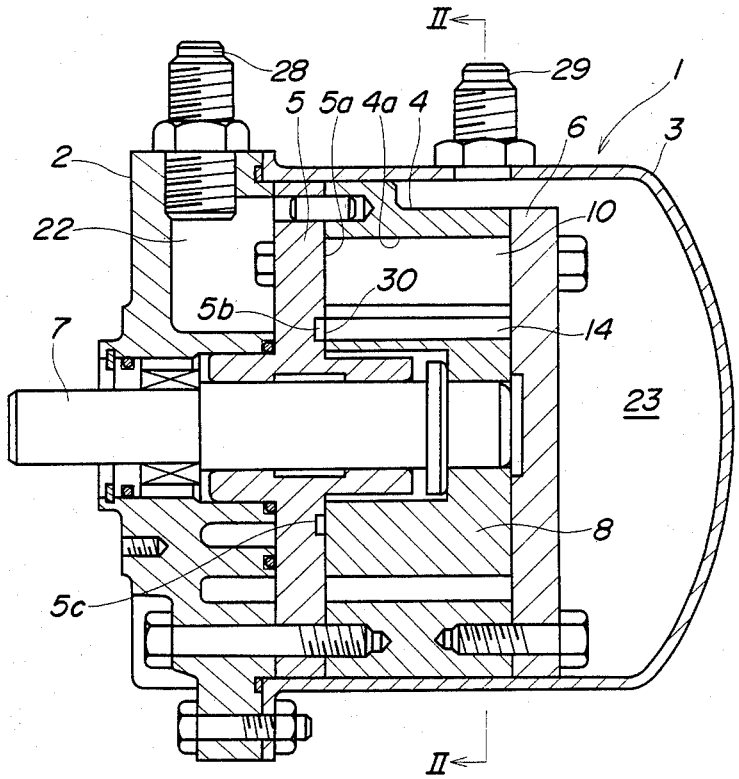
FIG. 1 is a longitudinal sectional view of a variable capacity vane compressor according to an embodiment of the invention.

The invention will now be described in detail with reference to the drawings illustrating an embodiment thereof.

In the drawings, a vane compressor 1 comprises a front head 2, a casing 3 secured to the front head 2, a cylinder 4 disposed within the casing 3 and having an endless camming inner peripheral surface 4*a* with an ellipsoidal cross section, and front and rear side blocks 5 and 6 secured to opposite ends of the cylinder 4. The cylinder 4 and the side blocks 5, 6 cooperate to form a pump housing. A rotor 8 is rotatably received within the pump housing and journalled by a rotary shaft 7 rotatably supportedly extending through the front side block 5. The rotor 8 has its outer peripheral surface formed therein with four slits 8*a* circumferentially arranged at equal intervals, and as many vanes 10 are radially slidably fitted in their respective slits 8*a*. The rotor 8 has its interior formed with axially extending back pressure chambers 14 communicating with radially inner ends of their respective slits 8*a*. Opposite ends of each of the back pressure chambers open in opposite ends of the rotor 8.

Two housing cavities 18 and 19 are defined between inner surfaces of the pump housing and the outer peripheral surface of the rotor 8. An inner end face 5*a* of the front side block 5 is formed therein with two generally semicircular grooves 5*b* and 5*c* disposed along the same circumference as the back pressure chambers 14 to serve as passages communicating their respective back pressure chambers 14 with each other. The grooves 5*b*, 5*c* are arranged separately from each other at locations diametrically opposite with respect to the rotary shaft 7 and corresponding in circumferential position to their respective housing cavities 18, 19. To be specific, they circumferentially extend about the rotary shaft 7 through a predetermined circumferential angle (e.g. 180 degrees), with their mutually opposed ends 5*b*', 5*c*'; 5*b*'', 5*c*'' separated from each other. Each of the grooves 5*b*, 5*c* can communicate its two adjacent back pressure chambers 14 with each other while the latter move along the former, and both open in a clearance 30 between opposed end faces of the rotor 8 and the front side block 5.

Figure 3:
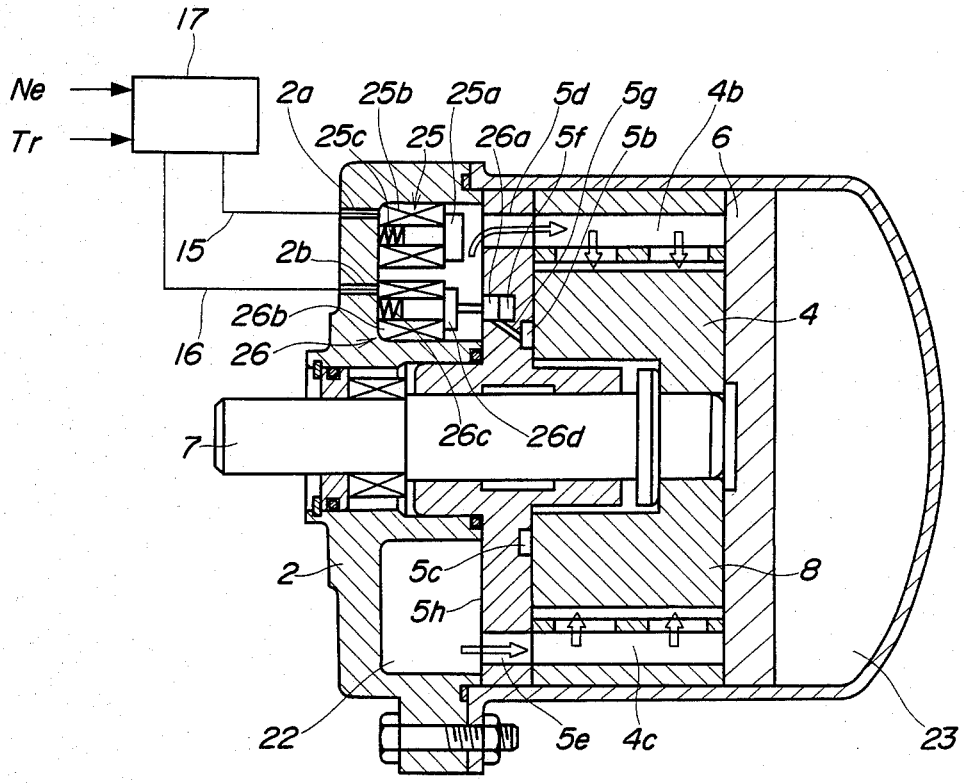
FIG. 3 is a longitudinal sectional view of the same compressor during full capacity operation, taken along line III—III in FIG. 2.
Figure 4:
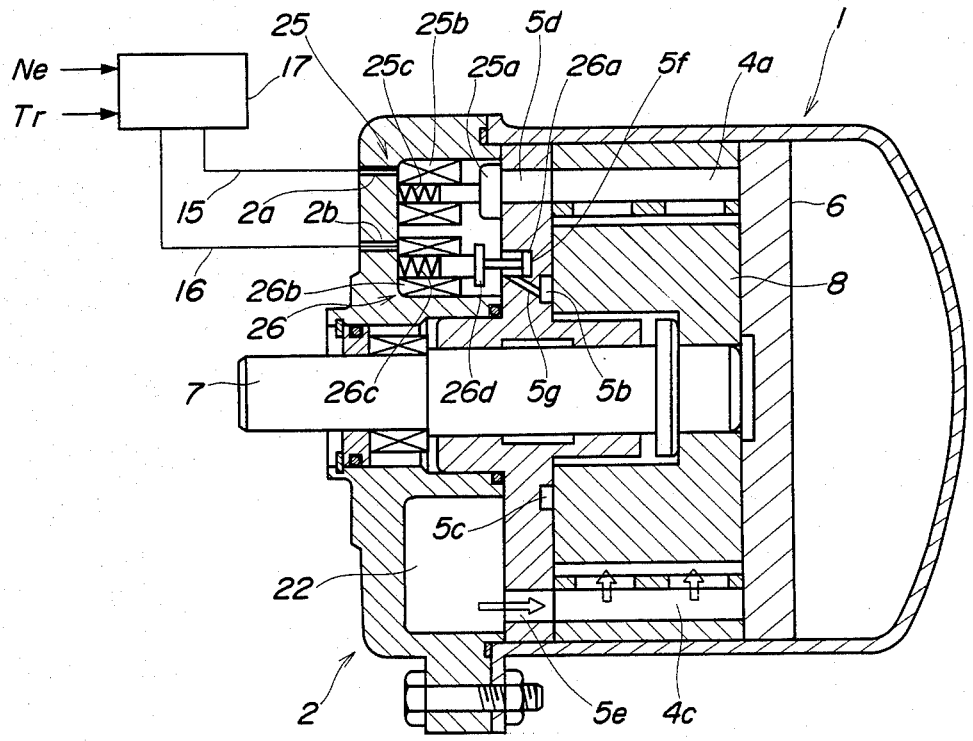
FIG. 4 is a view similar to FIG. 3, showing the compressor during half capacity operation.

The housing cavities 18, 19 communicate, on one hand, with respective pump inlets 4*b* and 4*c* formed in the wall of the cylinder 4, and on the other hand, with pump outlets 4*d* and 4*e* formed in the same wall and provided with discharge valves 20 and 21, respectively. As shown in FIGS. 3 and 4, the pump inlets 4*b*, 4*c* are communicated with a suction chamber 22 defined in the front head 2 by inner surfaces thereof and an outer end face of the front side block 5, by way of respective through holes 5*d* and 5*e* formed in the front side block 5, while the pump outlets 4*d*, 4*e* can be communicated with a discharge pressure chamber 23 defined within the casing 3 by inner surfaces thereof and outer surfaces of the pump housing, through their respective discharge valves 20, 21.

As shown in FIGS. 3 and 4, the outer end face of the front side block 5 facing the suction chamber 22 is formed therein with a blind hole 5*f* at a predetermined circumferential location corresponding to the groove 5*b*, and a small communication bore 5*g* is obliquely formed through the side block 5 and communicates the above blind hole 5*f* with the groove 5*b*.

Electromagnetic valves 25 and 26 are mounted in the front head 2 and disposed opposite the respective holes 5*d*, 5*f* in the side block 5 in such a manner that the valve body 25*a* of the electromagnetic valve 25 is in axial alignment with the hole 5*d* for closing same, while the valve body 26*a* of the electromagnetic valve 26 is slidably fitted in the hole 5*f*. Lead wires 15 and 16 extend to the outside from the solenoids 25*b* and 26*b* of the valves 25, 26 through holes 2*a* and 2*b* formed through the front head 2, for connection to an electromagnetic valve-control circuit 17. The control circuit 17 controls the energization of the electromagnetic valves 25, 26 in response to the rotational speed Ne of an engine associated with the compressor and/or the discharge refrigerant temperature Tr.

The valve body 25*a* of the electromagnetic valve 25 is disposed for displacement toward the hole 5*d* by the force of a spring 25*c* to block the hole 5*d* when the solenoid 25*b* is deenergized, and for displacement away from the hole 5*d* against the force of the spring 25*c* by electromagnetic force produced by the solenoid 25*b* to open the hole 5*d* for communication between the pump inlet 4*b* and the suction chamber 22 when the solenoid 25*b* is energized. The valve body 26*a* of the electromagnetic valve 26 is disposed to be held at the bottom of the blind hole 5*f* by the force of a spring 26*c* disposed in the central opening of the solenoid 26*b* when the latter is deenergized, whereby the bore 5*g* is opened to communicate the groove 5*b* with the suction chamber 22 (FIG. 4), while when the solenoid 26*b* is energized, it is displaced away from the bottom of the blind hole 5*f* against the force of the spring 26*c* due to electromagnetic force produced by the solenoid 26*b*, whereby an end of the communication bore 5*g* opening in the blind hole 5*f* is blocked by the outer peripheral surface of the valve body 26*a* to thereby interrupt the communication between the groove 5*b* and the suction chamber 22 (FIG. 3). In the latter position, the electromagnetic valve 26 has its stopper 26*d* brought into urging contact with the solenoid 26*c*.

The suction chamber 22 is communicated with a refrigerant circuit of an air conditioning system, not shown, by way of the interior of a suction connector 28 mounted on the front head 2, while the discharge pressure chamber 23 is communicated with the same circuit by way of the interior of a discharge connector 29.

With the above arrangement, to operate the compressor with full capacity, as shown in FIG. 3, the control circuit 17 energizes the electromagnetic valve 25 to cause displacement of the valve body 25*a* away from the hole 5*d* to open same 5*d* to establish the communication between the suction chamber 22 and the pump inlet 4*b* in the cylinder 4, and at the same time energize the electromagnetic valve 26 to cause displacement of the valve body 26*a* toward the solenoid 26*b* to close the communication bore 5*g* to interrupt the communication between the suction chamber 22 and the groove 5*b* in the front side block 5. Thus, the two housing cavities 18, 19 are communicated with the suction chamber 22 by way of their respective pump inlets 4*b*, 4*c* to be supplied with suction refrigerant. In this position, as the rotor 8 is rotated in the counterclockwise direction as indicated by the arrow A in FIG. 2, the suction refrigerant drawn into the housing cavities 18, 19 is compressed by vanes 10 moving together with the rotor 8, and forcively opens the discharge valves 20, 21 to be discharged into the discharge pressure chamber 23 through the pump outlets 4*d*, 4*e*.

Part of the refrigerant compressed in the housing cavities 18, 19 is forced to travel through a fine gap between opposed end faces of the front side block 5 and the rotor 8 into the respective grooves 5*b*, 5*c* in the side block 5, and then travels into the back pressure chambers 14 to increase the pressure therein to thereby obtain sufficient back pressure acting upon the vanes 10 to urge their radially outer ends against the camming inner peripheral surface of the cylinder 4. Another part of the refrigerant compressed in the housing cavities 18, 19 is forced to travel through fine gaps between the vanes 10 and their respective slits 8*a* into the back pressure chambers 14 to also contribute to the increase of the back pressure. The vanes 10 are positively held in sliding and urging contact with the camming inner peripheral surface 4*a* of the cylinder 4 by centrifugal force produced in themselves due to the rotation of the rotor, in addition to the above back pressure.

To operate the compressor with half capacity, as shown in FIG. 4, the control circuit 17 deenergizes the electromagnetic valve 25 to have its valve body 25*a* close the hole 5*d* in the front side block 5 whereby the associated pump inlet 4*a* becomes disconnected from the suction chamber 22, and at the same time the control circuit 17 deenergizes the electromagnetic valve 26 to have its valve body 26*a* displaced as far as the bottom of the blind hole 5*f* to open the communication bore 5*g* whereby the communication between the groove 5*b* and the suction chamber 22 becomes established.

In this position, no suction refrigerant is supplied from the suction chamber 22 to the housing cavity 18 but the other housing cavity 19 alone is supplied with suction refrigerant from the suction chamber 22 through the hole 5*e* and the pump inlet 4*c*.

Figure 2:
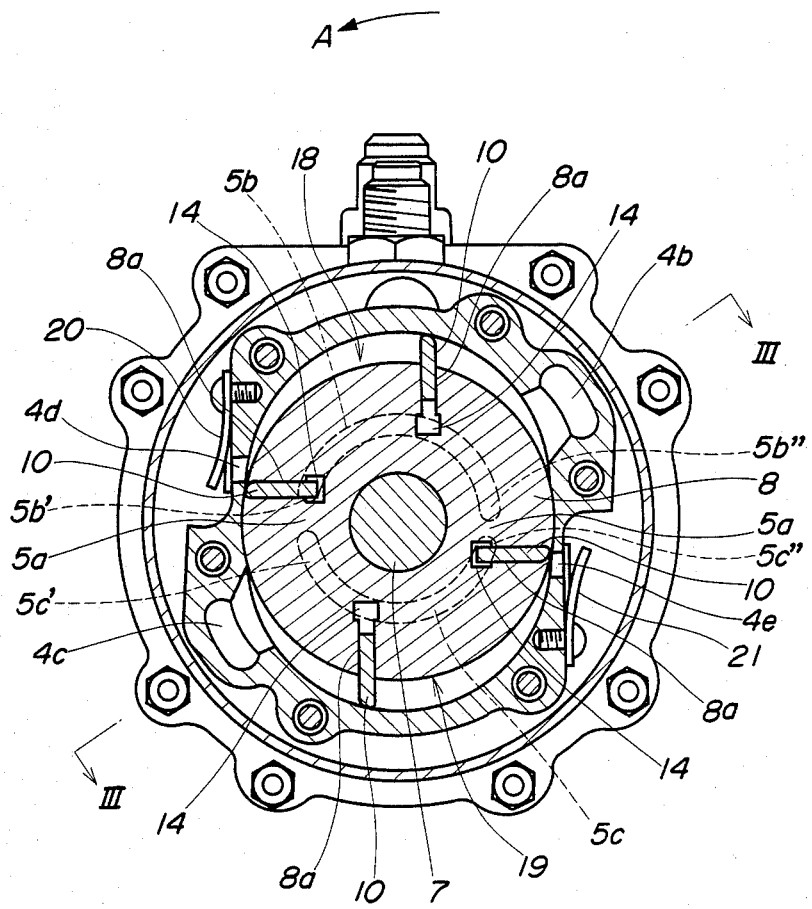
FIG. 2 is a transverse cross-sectional view taken along line II—II in FIG. 1.

On this occasion, as the rotor 8 rotates in the counterclockwise direction indicated by the arrow A in FIG. 2, a refrigerant compressing action takes place in the housing cavity 19 which is supplied with suction refrigerant, during its compression stroke, whereas no such action takes place in the other housing cavity 18 which is not supplied with suction refrigerant. The refrigerant compressed in the cavity 19 is discharged through the pump outlet 4*e* into the discharge pressure chamber 23 in the same manner as previously stated. At the same time, part of the refrigerant compressed in the cavity 19 is forced to travel into the associated groove 5*c* through a gap between a lower half of the end face of the rotor 8 closer to the cavity 19 as viewed in FIG. 2 and the opposed inner end face of the front side block 5, and then flow into back pressure chambers 14 as the latter move therealong to positively hold the radially outer ends of the vanes 10 in sliding and urging contact with the camming inner peripheral surface 4*a* of the cylinder 4 in the same manner as previously stated. Another part of the refrigerant compressed in the housing cavity 19 also flows through gaps between the associated vanes 10 and their slits 8*a* into the associated back pressure chambers 14 to obtain required back pressure. Due to this sufficient back pressure and centrifugal force produced in the vanes themselves, refrigerant compression is effected in the housing cavity 19 in a positive and stable manner.

On the other hand, on this occasion, no refrigerant compressing action takes place in the other housing cavity 18. Since on this occasion the groove 5*b* associated with the cavity 18 is communicated with the suction chamber 22 as previously noted, the pressure in the groove 5*b* is substantially equal to that in the suction chamber 22. Further, since the grooves 5*b*, 5*c* are separated from each other as previously noted and shown in FIG. 2, the compressed refrigerant under high pressure supplied to the groove 5*c* will not flow into the groove 5*b*. Therefore, low pressure prevails in the back pressure chambers 14 communicating with the grooves 8*a* in which are fitted vanes 10 moving in the housing cavity 18 on the upper half side in FIG. 2. Consequently, vanes 10 are free from large back pressure while they are travelling in the cavity 18 so that they have their radially outer ends in sliding contact with the camming inner peripheral surface 4*a* of the cylinder 4 with a small urging pressure corresponding to centrifugal force produced in themselves alone.

That is, during half capacity operation wherein the housing cavity 18 is held in a non-compressive state, while the vanes 10 are travelling in the cavity 18 in a non-compressive state, they are held in urging contact with the camming inner peripheral surface 4*a* of the cylinder 4 with a small urging pressure corresponding to the centrifugal force alone, whereas while the vanes 10 are travelling in the cavity 19 during normal compression stroke thereof, they are positively held in urging contact with the surface 4*a* with a large urging pressure corresponding to the sum of sufficient back pressure and centrifugal force.

As stated above, according to the invention, the back pressure acting upon the vanes can be controlled in different manners appropriate, respectively, to full capacity operation and half capacity operation of the compressor, thereby enabling the compressor to fully exhibit the fluid compressing function during full capacity operation, while reducing the power loss during half capacity operation.

Although the foregoing embodiment is directed to a vane compressor having two housing cavities, the invention is not limited to such type compressor but may be applied to other vane compressors having other numbers of housing cavities. Also, although in the embodiment means 5*d*, 25 for establishing and interrupting the communication between part of the housing cavities and the suction chamber and means 5*f*, 5*g*, 26 for controlling the communication between the groove 5*b* and the suction chamber are both provided on the side of the front side block 5 alone, one or both of such means may be provided at both of the side blocks 5, 6 or at the side block 6 alone.

Obviously many other modifications and variations of the present invention are possible in the light of the above teachings. It is therefore to be understood that within the scope of the appended claims the invention may be practiced otherwise than as specifically described.

What is claimed is:

1. A variable capacity vane compressor comprising: a cylinder having an endless camming inner peripheral surface; a pair of side blocks secured to opposite ends of said cylinder and cooperating with said cylinder to define a pump housing, said pump housing having at least two pump inlets and at least two pump outlets; a rotor rotatably received within said pump housing and having an outer peripheral surface thereof formed therein with a plurality of slits each having a radially inner end, said rotor cooperating with said pump housing to define therebetween at least two cavities, said pump inlets and said pump outlets opening in different ones of said cavities; a plurality of back pressure chambers formed in said rotor and communicating with said radially inner ends of respective ones of said slits; a plurality of vanes radially slidably fitted in said slits for sliding contact with said endless camming inner peripheral surface of said cylinder; a suction chamber; first valve means for selectively establishing and interrupting communication between at least one of said pump inlets and said suction chamber; at least two passage means formed in at least one of said side blocks at locations corresponding to different ones of said cavities and separated from each other, for supplying said back pressure chambers with compressed fluid as back pressure from respective ones of said cavities; at least one communication means formed in said at least one of said side blocks for communicating at least one of said passage means corresponding to said at least one of said pump inlets with said suction chamber; second valve means for selectively establishing and interrupting communication between said at least one of said passage means and said suction chamber by way of said communication means; and control means for controlling said first valve means and said second valve means, said control means being adapted to cause said first valve means to interrupt the communication between said at least one of said pump inlets and said suction chamber, and at the same time cause said second valve means to establish communication between said at least one of said passage means and said suction chamber by way of said communication means, thereby reducing the pressure of said compressed fluid supplied to said back pressure chambers by way of said at least one of said passage means.

2. A vane compressor as claimed in claim 1, wherein said at least one of said side blocks has one end face thereof opposed to one end face of said rotor, said passage means comprising a pair of generally semicircular grooves opening in a clearance between said one end face of said at least one of said side blocks and said one end face of said rotor and disposed at locations corresponding to different ones of said cavities, said back pressure chambers opening at least in said one end face of said rotor at locations alignable with said grooves.

3. A vane compressor as claimed in claim 1, wherein said second valve means comprises an electromagnetic valve.

4. A vane compressor as claimed in claim 1, wherein said at least one of said side blocks has another end face remote from said rotor, said communication means comprising a communication bore formed in said at least one of said side blocks, said second valve means comprising a hole formed in said at least one of said side blocks and opening in said another end face thereof, said communication bore of said communication means opening in said hole, a valve body slidably fitted in said hole and adapted to selectively assume a first position in which it opens said communication bore, and a second position in which it closes said communication bore, and actuator means for actuating said valve body to assume selectively said first position or said second position.

5. A vane compressor as claimed in claim 4, wherein said actuator means comprises a spring for biasing said valve body in a direction in which said valve body is slidable, and a solenoid energizable to displace said valve body against the force of said spring.

6. A vane compressor as claimed in claim 5, including a head to which said at least one of said side blocks is secured, said head having inner surfaces thereof cooperating with said at least one of said side blocks to define said suction chamber therebetween, said solenoid being located in said head and disposed opposite said hole.

* * * * *